United States Patent [19]

Nowak et al.

[11] 4,431,403

[45] Feb. 14, 1984

[54] BURNER AND METHOD

[75] Inventors: Leonard G. Nowak, Palmyra; Raymond J. Wojcieson, Annville, both of Pa.

[73] Assignee: Hauck Manufacturing Company, Lebanon, Pa.

[21] Appl. No.: 256,851

[22] Filed: Apr. 23, 1981

[51] Int. Cl.[3] ..... F23M 9/00; F23D 15/02

[52] U.S. Cl. ..... 431/183; 431/352; 431/284; 239/400; 239/405

[58] Field of Search ..... 431/174, 182, 183, 184, 431/284, 285, 351, 352, 353; 239/400, 402, 403, 405

[56] References Cited

U.S. PATENT DOCUMENTS

| | | | |
|---|---|---|---|
| 2,989,119 | 6/1961 | Burt | 431/353 |
| 3,031,012 | 4/1962 | Brola | 431/183 |
| 3,153,438 | 10/1964 | Brzozowski | 239/405 X |
| 3,187,799 | 6/1965 | Nesbitt | 431/353 |
| 3,220,460 | 11/1965 | Goubsky et al. | 431/353 |
| 3,245,457 | 4/1966 | Smith et al. | 431/352 |
| 3,746,499 | 7/1973 | Guerre et al. | 431/182 |
| 3,768,250 | 10/1973 | Kawaguchi | 239/400 |
| 3,775,039 | 11/1973 | Pillard | 431/183 X |
| 3,912,164 | 10/1965 | Lefebvre et al. | 239/400 |

FOREIGN PATENT DOCUMENTS

| | | | |
|---|---|---|---|
| 3000 | 7/1979 | European Pat. Off. | 431/182 |
| 649845 | 8/1937 | Fed. Rep. of Germany | 431/182 |

*Primary Examiner*—Samuel Scott
*Assistant Examiner*—Margaret A. Focarino
*Attorney, Agent, or Firm*—Finnegan, Henderson, Farabow, Garrett & Dunner

[57] ABSTRACT

A multi-fuel industrial heating burner having an exhaust velocity of about 15,000 feet per minute. The fuel is first burned in a swirling toroidal recirculation zone and flows into the burner tile and shear mixes with a counter-swirling flow of combustion air flowing along the burner tile. As the flows shear mix, additional combustion air is provided to the central burning gases and the rotational momentum of the swirling flows is dissipated. The burner discharge gases flow axially without swirl.

9 Claims, 8 Drawing Figures

Fig. 2
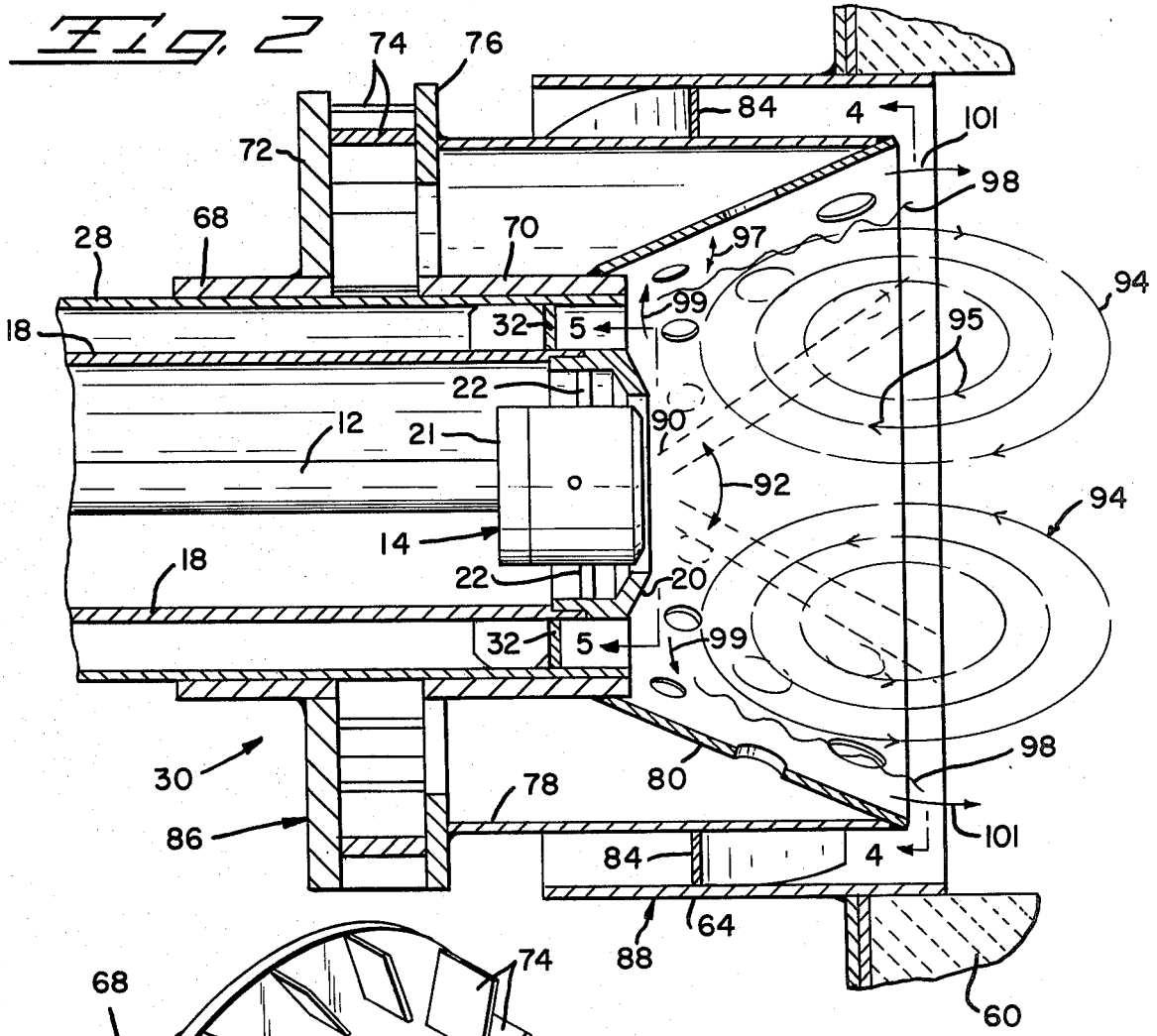
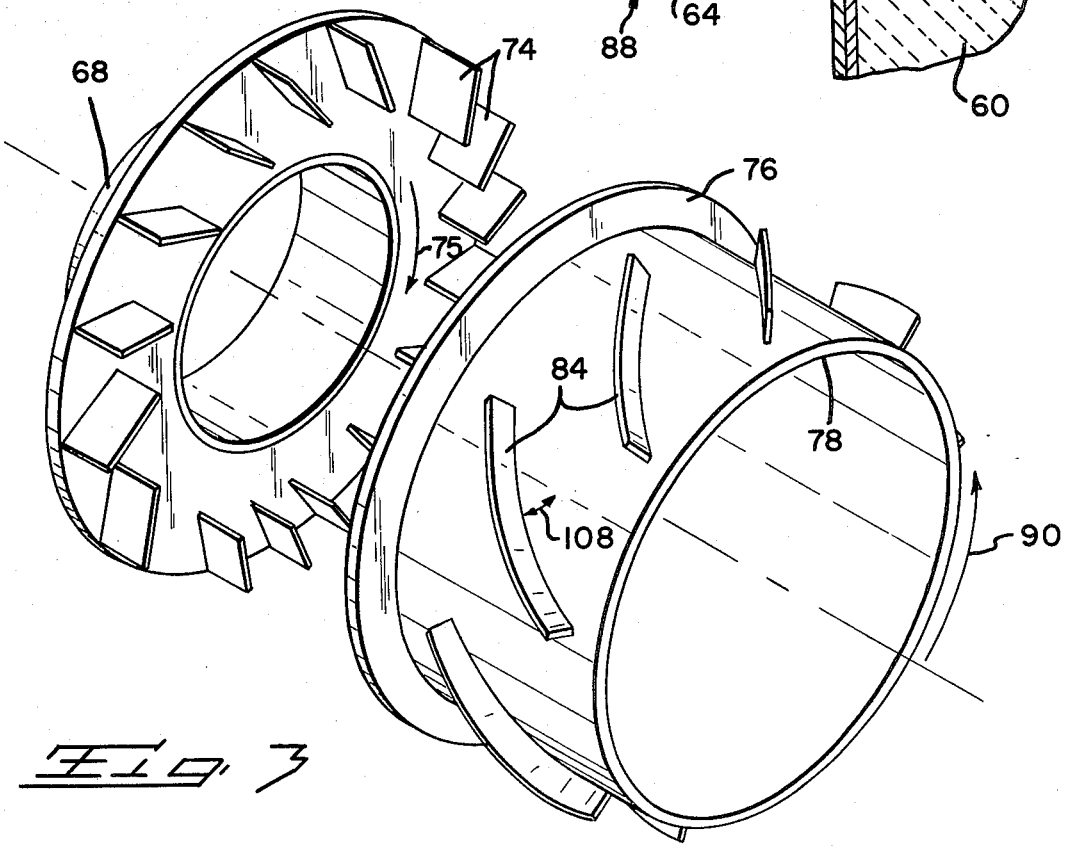
Fig. 3

BURNER AND METHOD

The invention relates to an improved heating burner of the type used to fire industrial heating furnaces for a number of applications including melting aluminum and heat-treating and normalizing metal parts, firing ceramics, glassware and other like applications.

Conventionally, low-velocity burners are used to heat industrial furnaces of this type with the exhaust gases flowed directly into the furnace so that they surround and heat the work materials in the furnace. Ultimately, the exhaust gases are vented through an exhaust stack.

A conventional industrial burner of the type used for this type of application has exhaust gas velocities of between about 3,000 to 8,000 feet per minute. As the gases flow through the interior of the heating furnace, they surround and heat the work materials by both convective heating and radiant heating. U.S. Pat. No. 3,254,846 discloses a conventional low-velocity burner of the type presently used for industrial heating.

Some work material, such as aluminum and other metals, has a bright highly reflective surface which inhibits the absorption of radiant energy and thereby limits radiant heat transfer efficiency. Additional heating time or higher furnace operating temperature is required to raise the material temperature to a given level.

In some conventional industrial heating burners, the discharge gases are swirled and thrown radially outwardly after exiting from the burner. Such radial dissipation separates burner gases and can reduce combustion efficiency.

The burner of the present invention efficiently burns a number of fuels including natural gas and No. 2 through No. 6 fuel oils. Combustion within the burner and refractory tile is controlled in an initial toroidal recirculation combustion zone located within a flame retention cone. Secondary air flow openings in the cone admit swirling secondary air which forms the recirculation zone and swirls the fuel-rich burning gas downstream against a counter-swirling flow of secondary combustion air on the smooth interior surface of the burner tile.

The shear mixing between the two swirling flows provides additional combustion air to the central fuel-rich burning gases to sustain the combustion required to expel the gases from the mouth of the tile at an exit velocity of about 15,000 feet per minute. When the burner is fueled by oil, as much as 60 percent of the oil is burned within the tile in order to achieve the high exit velocity. When the burner is fueled by gas, an even greater percentage of the available gas may be burned within the tile.

The angular momentum of the swirling secondary air supplied through the flame retention cone to the burning recirculation toroidal zone is equal but opposite in direction to the angular momentum supplied to the secondary air swirling downstream along the burner tile. As the two swirling flows shear mix to supply additional combustion air from the outer flow to the inner burning flow, the opposite angular momentums of the flows cancel each other within the tile so that the high-velocity discharge gases move axially.

The linear high-velocity exhaust gas flow actively stirs the furnace gases and increases convective contact between the furnace gases and the work material in the furnace.

The high combustion gas exit velocity of the new burner increases the heating efficiency of furnaces over present burners using the same firing rate. The increase in efficiency may be as much as 20 percent. This increased efficiency enables the work material to be heated to desired temperatures within a shorter period of time. Alternatively, the firing rate can be reduced and the heating time kept constant. Furnace stack temperatures are reduced, thereby increasing the useful life of the refractory materials.

The outer swirling secondary air flow moving along the burner tile insulates the tile from the very hot burning gases in the center of the tile and also protects the tile from fuel particles which might otherwise be thrown against the tile causing undesired residues. Without the protective secondary air sheath, the tile would be exposed to high temperatures which could corrode or even melt the tile and which would subject the tile to high thermal expansion stresses. The protective sheath serves to maintain the combustion heat within the center of the tile where it efficiently expands the combustion gases to achieve a high discharge velocity.

The flame retention cone assures that the secondary air flowing through the secondary air openings is uniform throughout the inner surface of the cone, thereby promoting the toroidal reverse flow of burning gases within the cone. At low burn, bluff body recirculation of hot combustion gases across the flame front adjacent the inner surface of the cone aids in stabilizing the burner flame.

Other objects and features of the invention will become apparent as the description proceeds, especially when taken in conjunction with the accompanying drawings illustrating the invention, of which there are three sheets and two embodiments.

IN THE DRAWINGS

FIG. 2 is an enlarged view of a portion of FIG. 1 illustrating the burner air nozzle assembly;

FIG. 3 is an exploded view illustrating swirlers used in the burner air nozzle assembly;

DESCRIPTION OF THE BURNER

Figure 1:
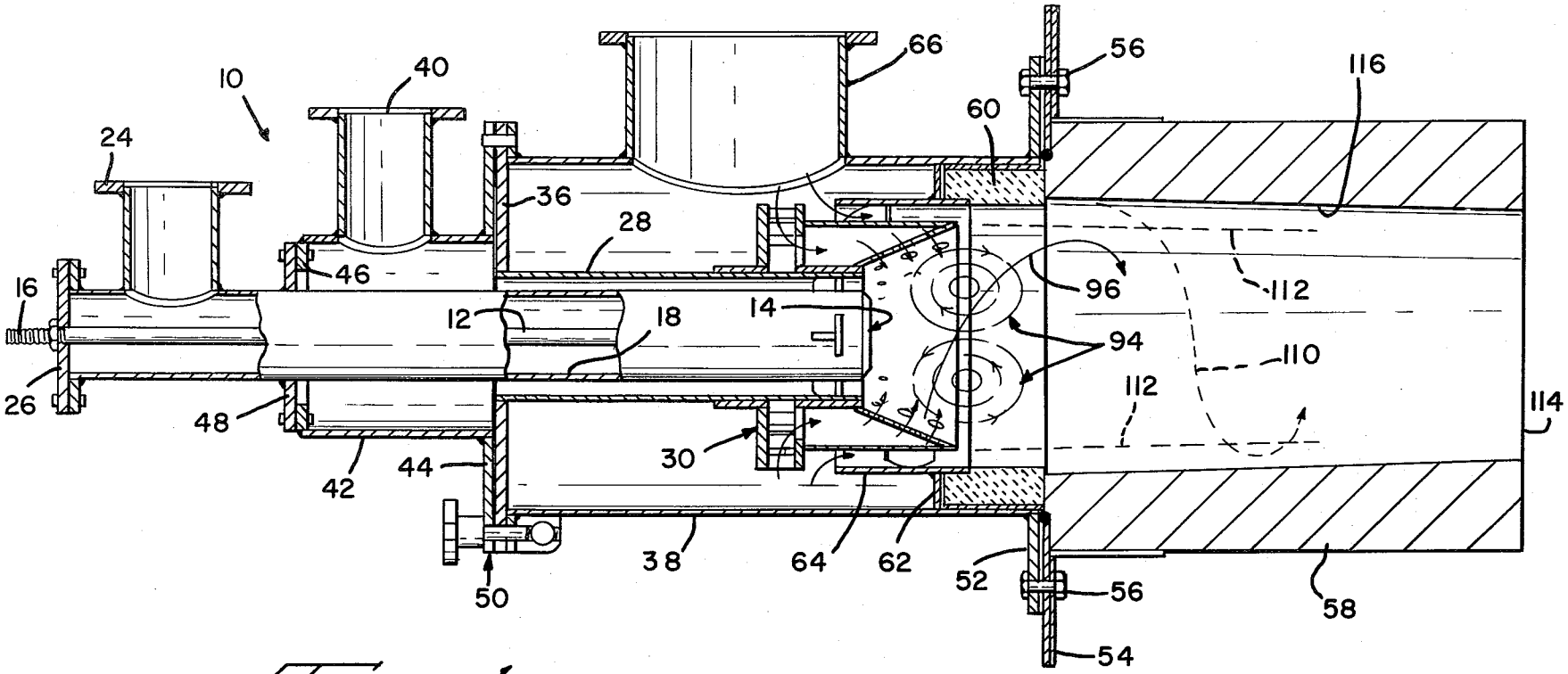
FIG. 1 is a sectional view illustrating the burner and refractory tile.

Burner 10 includes an axial fuel oil pipe 12 having a fuel atomizer 14 mounted on the downstream thereof and a connection 16 on the upstream end thereof for attachment to an oil supply system. Primary air pipe 18 surrounds the oil pipe. The atomizing assembly 14 includes an annular cap 20 on the downstream end of the primary air tube and a main body 21 on the end of the oil pipe having a number of radially spaced legs 22 which centralize the body within the cap while permitting slight axial movement of the body with respect to the cap due to differential thermal expansion. The upstream end of primary air pipe 18 includes a primary air inlet 24 and an end plate 26. The primary inlet 24 is connected to a suitable primary air source. Oil pipe 10 extends through and is secured to the end plate 26 as illustrated.

Figure 5:
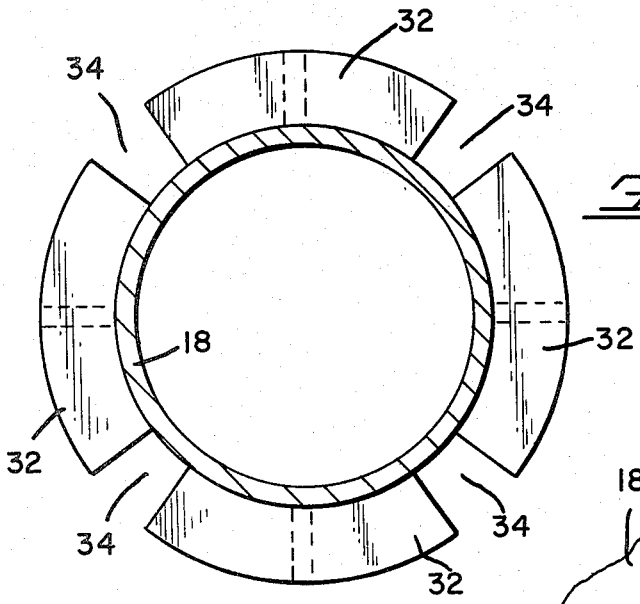
FIGS. 5 and 6 illustrate gas baffles used in the assembly.
Figure 6:
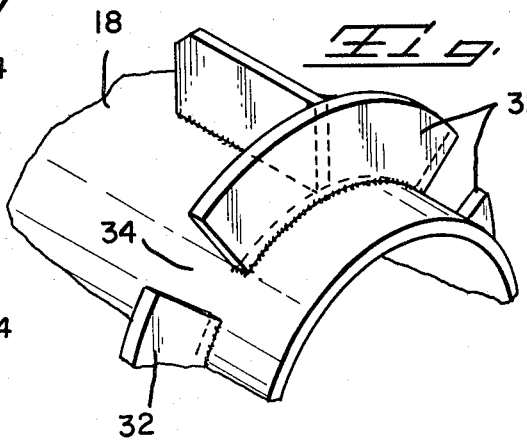

Gas pipe 28 surrounds the downstream end of the primary air pipe 18. Burner air nozzle assembly 30, illustrated in FIGS. 2 and 3, is mounted on the downstream end of the gas pipe. Gas baffles 32 are carried on the downstream end of the primary air pipe 18 and surround the pipe as shown in FIG. 5 with four narrow gas flow apertures 34 located between the ends of adjacent baffle plates. The baffle plates locate the primary air pipe within the gas pipe.

The upstream end of the gas pipe 28 is secured to the center of circular end plate 36 which closes the upstream end of large diameter secondary air pipe 38. Gas inlet 40 extends to one side of inlet pipe section 42 attached at a downstream end to circular end plate 44 overlying plate 36. The upstream end of pipe 42 carries mounting ring 46 which is removably attached to ring 48 on primary air pipe 18. A suitable, releasable clamp connection 50 secures end plates 36 and 44 to the upstream end of secondary air pipe 38. The interior opening of ring 46 is sufficiently large to permit withdrawal of the primary air pipe and baffles 32 through the ring.

The downstream end of secondary air pipe 38 includes an exterior mounting ring 52 secured to the furnace plate 54 by bolts 56. These bolts also secure the main refractory tile 58 in place in axial alignment with burner 10. Annular refractory ring 60 is mounted on the interior of the downstream end of secondary air pipe 38 between the end of the tile 58 and ring 62 on secondary pipe 38. Ring 62 supports a cylindrical tube 64 surrounding the downstream end of burner air nozzle assembly 30. The secondary air pipe 38 carries a secondary air inlet 66 attached to a suitable source of secondary air.

Burner 10 is readily disassembled from the upstream end to facilitate cleaning or maintenance as required. The main body of the atomizer assembly and oil pipe tube 12 may be freely withdrawn from the primary air pipe upon removal of end plate 26 from pipe 18. Gas inlet pipe 42 may be withdrawn from the burner upon release of connection 50. Release of this connection also permits withdrawal of the gas pipe 28 and attached burner air nozzle assembly 30 from the burner. Tube 64 remains attached to ring 62.

Referring now to FIGS. 2 and 3, the burner air nozzle assembly 30 includes axially spaced collars 68 and 70 mounted on the downstream end of gas pipe 28. Radial ring 72 is secured to collar 68 and extends radially outwardly therefrom. A set of radial swirled vanes 74 extend between ring 72 and a downstream ring 76 spaced outwardly from the upstream end of collar 70. As illustrated in FIG. 3, radial swirl vanes 74 rotate a flow of secondary air in a clockwise direction when viewed looking upstream into the burner. See arrow 75.

Figure 4:
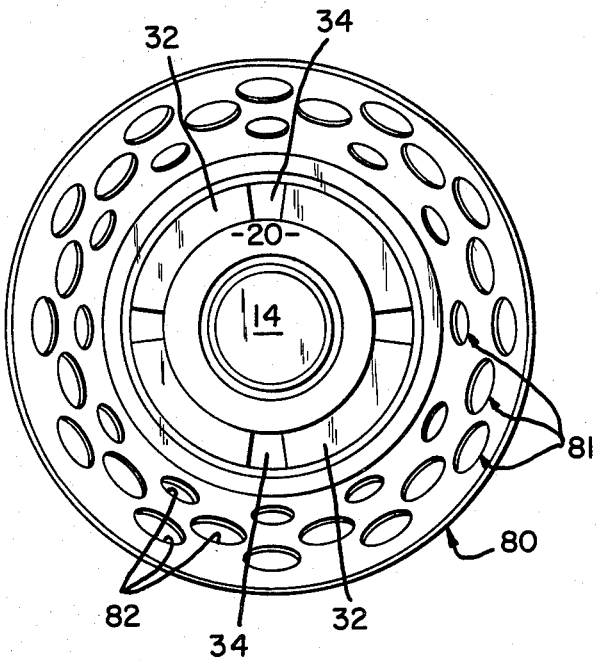
FIG. 4 is a view taken along line 4—4 of FIG. 2.

Outer collar 78 joins ring 76 and extends downstream therefrom past the atomizer assembly 14 and the ends of the primary air and gas pipes 18 and 28. A frustroconical flame retention cone 80 extends from the downstream end of collar 70 to the downstream end of the larger surrounding collar 78. As illustrated in FIG. 4, cone 80 includes three circumferential rows 81 of round secondary air flow openings 82. Each row 81 is made up of 12 equally spaced openings. The openings in adjacent rows are staggered with respect to each other so that, as illustrated in FIG. 4, the openings in the second row are spaced circumferentially between the openings in the first and third rows. The openings in the first and second rows are the same diameter while the openings in the third, innermost row are somewhat smaller than the other openings.

The outer surface of collar 78 carries a plurality of circumferential swirl vanes 84 which have a sliding fit within fixed tube 64.

The rings 72 and 76 and radial swirl vanes 74 form a secondary air radial swirl assembly 86 such that secondary air from inlet 66 flows past the vanes 74, is rotated clockwise in the direction of arrow 75 and swirls clockwise down the space between collars 70 and 78. The clockwise swirled flow of secondary air streams out through cone holes 82 into the interior of the cone downstream of the atomizing assembly 14. The swirling air tends to be thrown out against outer collar 78 and to flow downstream along the collar until it reaches the cone 80. The perforated cone partially dams the axial movement of the rotating flow to assure that there is an essentially uniform pressure drop across the cone at the three rows of openings so that the secondary air flow through a given opening is not dependent upon the axial location of the opening on the cone. Of course, more air flows through the larger openings of the outer two rows than through the smaller openings of the inner row.

The tube 64, collar 78 and circumferential swirl vanes 84 form a circumferential swirl vane assembly 88. Secondary air from inlet 66 flows between collars 64 and 78 and is swirled by vanes 84 in a counterclockwise direction as indicated by arrow 90 shown in FIG. 3. The counterclockwise swirled secondary air is thrown radially outwardly against the inner walls of the refractory ring 60 and main refractory tile 58 to cool and protect the ring and tile, as will be described more fully.

The burner air nozzle assembly 30 includes the radial swirl vane assembly 86, the perforated flame retention cone 80 downstream from the radial swirl vane assembly and the outer surrounding circumferential swirl vane assembly 88. The swirl vane assemblies 86 and 88 rotate secondary air flows in opposite circumferential directions. The interaction between the flows improves the operation of the burner.

OPERATION OF THE BURNER

Burner 10 may be fired using either gas or oil as a fuel. The operation of the burner will first be described at oil-fired high burn.

At oil-fired high burn, the fuel supplied through oil pipe 12 to atomizer 14 is pressurized to about 1 to 2 pounds per square inch so that the atomizer delivers an axially aligned hollow conical spray of droplets 90 into and beyond the interior of the flame retention cone 80. Spray angles 92 of between 45° and 75° give good performance. Performance is reduced with too small or too large a spray angle as described subsequently.

The pressure of the primary air flowing through inlet 24 may vary from 16 to 24 ounces per square inch, depending upon the grade of oil being burned. The higher pressure is required in order to atomize heavy viscous No. 6 oil. Secondary air supplied through inlet 66 is at a pressure of about 8 ounces per square inch. At an oil-fired burn using No. 6 oil, primary air may be as much as 15 percent of total air supplied to the burner while secondary air supplies the remaining 85 percent of the air. Less primary air is required when lighter grade oils are burned.

The secondary air supplied through inlet 66 is divided into flows to the combustion chamber through the radial and circumferential vane assemblies 86 and 88. Approximately 30 to 40 percent of secondary air passing through the radial swirl vane assembly 86 and the remaining secondary air passes through the axial swirl vane assembly.

Secondary air flowing through radial swirl vane assembly 86 is swirled in a clockwise direction and flowed downstream between collars 70 and 78. The swirling air is thrown outside against collar 78 and flows along the collar to the flame retention cone. The cone partially blocks flow of the swirling air outwardly from the collar and assures that streams of clockwise swirling air flow into the interior of the cone through all of the holes 82. These swirling streams then swirl radially outwardly along the interior of the cone and form a radial pressure gradient across the cone with the lower pressure present at the cone axis. The flow of secondary air through openings 82 reduces the axial pressure sufficiently to set up a toroidal internal recirculation zone 94 indicated generally in FIGS. 1 and 2 with upstream flow adjacent the burner axis and downstream flow adjacent the cone 80. Gas in zone 94 also swirls axially downstream in a clockwise direction, as indicated in FIG. 1 by the arrow 96, while recirculating in zone 94.

Atomizer 12 delivers a hollow conical spray of fine fuel oil droplets into recirculation flow zone 94. The spray angle 92 is sufficiently great to prevent fuel droplets from being sprayed into the axial low-pressure zone where the downstream movement of the particles would oppose and inhibit the reverse or upstream gas flow. Spray angle 92 is sufficiently small so that the oil droplets are not thrown outwardly against the surface of cone 80 and the surrounding downstream combustion chamber where the oil would burn inefficiently and leave a residue. The oil droplets are sprayed into the recirculation zone 94 across the recirculating and swirling flow as illustrated in FIG. 2, well away from both the burner axis and cone 80. This spray provides the droplets with a desirable long residence time in the zone 94 to improve heating, evaporization and, ultimately, combustion. Using a flame retention cone 80 having a half angle 97 of about 25° and with the discharge end of the atomizer at the base of the cone, wide spray angles 92 of between 45° and 75° provide efficient combustion. Narrower spray angles produce a long, luminous and slow-burning flame. Wider spray angles deposit a heavy deposit of oil on the cone and combustion chamber walls.

The atomized spray of air and oil droplets passes through the toroidal vortex of hot burning, recirculating gases. Some of the vaporized fuel reacts with the primary air and burns within the recirculation zone. Some fuel is swirled around and along the recirculation zone, mixes with incoming air and is burned within the cone region and further downstream. Some droplets and vapor also penetrate through the recirculation zone 94 and are carried downstream before being burned. Arrow 96 indicates that the clockwise downstream swirl of the mixture of air, burning fuel and fuel droplets.

The position of the flame front adjacent the interior surface of cone 80 is indicated generally by lines 98 shown in FIG. 2. The formation of the flame front 98 is described with reference to FIG. 7 which illustrates a portion of a section through the flame retention cone 80. The portion of the cone between adjacent holes 82 forms a bluff body 100 so that when swirling secondary air is flowed through the holes 82 a low-pressure zone 102 is formed behind the body 100. The low-pressure zone can extend beyond the surface of a cone a distance four or five times the distance across a body. The zone extends across the flame front 98 so that higher-pressure, hot burning gases from the combustion side of the front flow into the low-pressure zone 102 as indicated by arrows 104. The velocity of the secondary air flowing through openings 82 reduces the static pressure adjacent body 100 so that the hot gases and unburned fuel in the low-pressure zone 102 are entrained with and heat the secondary air flowing through the holes, as indicated by arrows 106. Once this air and fuel mixture is sufficiently hot to support combustion, the flame front 98 stabilizes at a position where the speed of upstream flame propagation equals the downstream velocity of the mixture.

Openings 82 are sequentially spaced throughout the cone and maintain a continuous generally conical flame front in the cone. The highly turbulent zones promote mixing and facilitate recirculation of combustion products back to the flame front.

In practice, at high burns the flame front 98 stabilizes a short distance inwardly of the cone while the position at a given instant fluctuates dependent upon a number of parameters. Some outer recirculated hot gases and unburned fuel in zone 94 are drawn under the upstream end of the flame front between the front and cone 80 and aid in preheating fuel and the secondary air/flowing through holes 82. See arrows 99. Gases from below the flame front are drawn into the downstream outer edge of the toroidal vortex and recirculate through the combustion zone prior to burning. See arrows 101.

Figure 7:
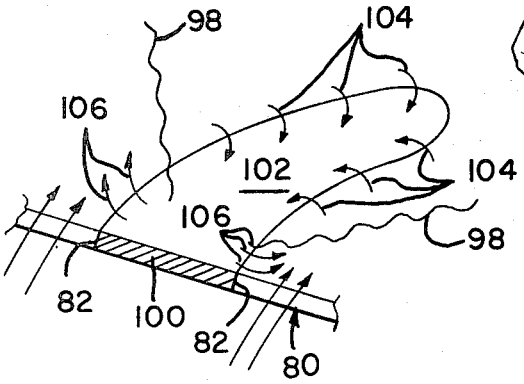

When at high burn with No. 2 oil, a stable flame may be maintained without rotating the secondary air flowing through cone holes 82. The flame is sustained by mixing and heat transfer back to the flame front through the small recirculation zones adjacent the surface of the cone, as shown in FIG. 7.

At high firing using heavy No. 6 fuel oil it is not possible to stabilize the flame in cone 80 without swirling the secondary air flowing through openings 82. This is because greater energy is required to vaporize the larger oil droplets of the more viscous and larger hydrocarbon molecules of No. 6 oil than is required to vaporize lighter fuel oils. The reverse flow toroidal zone increases the temperature of the mixing zone and lengthens the time of mixing in order to vaporize and burn heavy oil.

The secondary air flowing through axial swirl vane assembly 88 is swirled in a counterclockwise direction by vanes 84 which may be oriented at an angle 108 of between 45° to 55° to a line parallel to the burner axis. The 60 percent to 70 percent of total secondary air passing through assembly 88 is swirled in a counterclockwise direction. The swirl throws this flow radially outwardly and holds the flow against the interior surfaces of ring 60 and tile 58 as it moves toward the tile mouth 114. See arrow 110 shown in FIG. 1. Lines 112 generally indicate the shear mixing interface between the inner clockwise rotating flow indicated by arrow 96 and the outer counterclockwise rotating flow indicated by arrow 110.

At high burn, the exhaust gases leaving the tile mouth 114 have a velocity of approximately 15,000 feet per minute. This velocity is achieved by expansion of the gases within the burner. High expansion requires that a considerable portion of the available fuel, probably as much as 60 percent, be burned within the burner. Such intense combustion in the burner releases heat sufficient to erode or melt the refractory ring 60 and tile 58. The problem is exacerbated when the burner is fired by heavy fuel oils, such as No. 6, because burning of these oils releases large amounts of radiant energy resulting in high wall temperatures. Also, impurities in the heavy oils react with the refractory to further shorten refractory life. Thermal expansion resulting from rapid heat-up of the tile can crack the refractory material.

The swirling outer stream of relatively cool secondary air flows along the smooth inner surfaces of ring 60 and tile 58 to form a cooling and protective barrier separating the hot counter swirling inner flow from the refractory surface. The inner surface of the combustion chamber is round and without sharp changes in geometry in order to prevent adverse pressure gradients which would cause the outer flow to separate from the walls of the combustion chamber. The internal diameter of ring 60 is slightly less than the diameter of tile 58 adjacent the chamber in order to assure that when the ring and tile are mounted together the tile does not overlap the interior surface of the ring to separate the outer flow from the tile surface.

The outer secondary air flow shields the tile surface from oil droplets thrown radially outwardly of the swirling inner air stream to keep the tile free of fuel residue buildup which would occur if the oil were allowed to hit the tile. Such residue builds up on the tile and physically obstructs gases flowing through the tile. During combustion the air sheath protects the tile from fuel impurities which could otherwise penetrate the tile material and shorten tile life.

Contact between the inner and outer counter-swirling streams causes turbulent shearing to occur along the interface 112. This shearing gradually heats the swirling outer secondary air and mixes it with the hotter burning, counter-rotating inner swirling gases. By the time the flows have moved approximately two-thirds the length of the combustion chamber 116 in tile 58, the shearing interaction between the flows has dissipated the circumferential components of the flow and subsequent flow through the tile and out mouth 114 is axial, without swirl.

Burner 10 burns fuel in a two-step combustion process. Combustion is initiated in the violently swirling fuel-rich inner reverse flow zone gases and continues as these gases are swirled away from cone 80 and are shear mixed with the counter-swirling outer protective sheath of secondary air. This sheath provides additional oxygen for sustaining combustion away from the cone. Delayed mixing of additional combustion oxygen to a burning rich fuel mixture limits formation of undesirable $NO_x$ gases in the combustion process.

At low oil-fired burn the oil pressure is reduced, primary air pressure is unchanged and secondary air pressure is reduced to a level required to sustain a flame. As inner secondary air swirl is reduced the recirculation in zones 102, illustrated in FIG. 7, becomes more important in mixing and recirculating hot gases back to the flame front to stabilize the flame on cone 80.

When burner 10 is gas-fired, atomizer 14 may be withdrawn from the burner and the primary air may be shut off. Gas flows to the burner under a few ounces of pressure and is accelerated as it passes through spaces 34 between baffle plates 32. This accelerated flow promotes turbulence and mixing while preventing the fuel from burning within gas tube 28.

Burner 10 as disclosed is capable of firing on other fuels than oil or natural gas. For instance, it may be fired on producer gas. In some applications, preheated combustion air with temperatures as high 1200° F. may be used.

In burner 10, approximately twice as much secondary air flows through the circumferential swirl vane assembly 88 as flows through the radial swirl vane assembly 86. In order to assure that the shear engagement between the resultant flows at boundary 112 cancels the swirl of each flow, the radial and circumferential swirl vane assemblies 86 and 88 each impart equal angular momentum to their respective secondary air flows. The angular momentum per unit time provided to each of the two flows is equal in magnitude but opposite in direction.

The amount of inner secondary air flow passing through assembly 86 is smaller than the amount of outer secondary air flow and rotates about a shorter radius than the outer air flow. Accordingly, in order to cancel angular momentum, radial swirl vane assembly 86 provides a more active swirl to the inner flow than assembly 88 provides to the outer flow. The actively swirled inner flow improves the efficiency of the burner by providing a strong reverse flow zone 94 for initial combustion.

Figure 8:
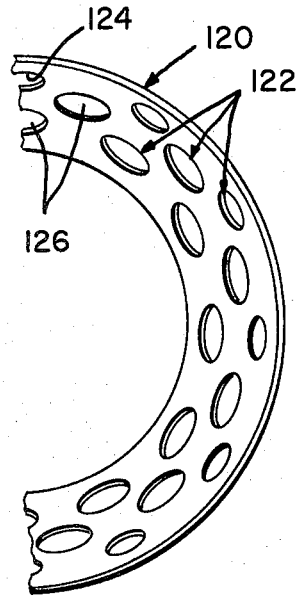
FIG. 7 illustrates combustion dynamics of the interior of the surface of the flame retention cone and FIG. 8 illustrates an alternative flame retention cone.

FIG. 8 illustrates a second embodiment flame retention cond 120 for use in burner 10 in place of flame retention cone 80. Cone 120 has the same frustroconical shape as cone 80 and is installed in burner 10 in place of cone 80. Secondary air flow through cone 120 creates a toroidal reverse flow zone as previously described.

The cone 120 includes three rows 122 of circumferentially spaced air flow holes. The holes are essentially uniformly spaced on the cone. The difference between cones 80 and 120 is that the outermost row of holes 124 is smaller in diameter than the holes 126 forming the inner two rows 122. As in cone 80, the holes are spaced circumferentially between the holes of adjacent rows.

The outer end of the cone 120 with reduced diameter holes 124 efficiently dams the centrifugally outwardly swirled flow of air on collar 78 to reduce the swirled flow through the holes 124 and increase the swirled flow through the larger diameter central and inner holes 126. The increased swirled secondary air flowing into the cone adjacent the atomizer assembly 114 swirls out along the surface of the cone as described previously and provides an improved protective air sheath on the surface of the cone to reduce fuel oil particles from the atomizer 14 from splashing on the cone and leaving undesirable residues. The air flow holes 124 and 126 on cone 120 are sufficiently closely spaced to maintain flame front recirculation combustion as shown in FIG. 7.

In conical fuel spray 90 the bulk of the atomized fuel is discharged from assembly 14 along the outer surface of the cone defining the spray angle 92 while some of the droplets are discharged within the hollow center of the cone. Likewise, some droplets from assembly 14 are discharged outwardly of the cone. These droplets are entrained within the protective gas flow and are carried beyond the cone. Heavy fuel oils are particularly susceptible to splashing on the cone and leaving deposits.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim our invention is:

1. An industrial heating burner including a fuel discharge device, an axial fuel supply pipe extending upstream from the fuel discharge device, a flame retention cone surrounding the fuel discharge device and extending downstream from and radially outwardly of the device, a first combustion air swirl generator having an inlet for receiving a supply of combustion air and an outlet, an outer collar surrounding the fuel supply pipe, said outer collar having a downstream end joined to the flame retention cone and an upstream end joined to the swirl generator outlet, and a plurality of secondary air flow holes formed through said flame retention cone within said outer collar, said holes being essentially uniformly spaced on the surface of the cone whereby combustion air swirled by said generator flows inside said outer collar, is thrown radially outwardly against said outer collar and is partially dammed by the cone to provide an essentially uniform swirling flow of combustion air through the openings in the cone and around the interior of the cone;

wherein said first air swirl generator surrounds the fuel supply pipe and the burner includes a second combustion air swirl generator surrounding the flame retention cone and the outer collar and having an inlet for receiving a supply of combustion air and an annular outlet surrounding the downstream end of the cone and the outer collar, said second swirl generator swirling combustion air in a direction opposite to the direction of swirl of said first combustion air swirl generator; and wherein said first air swirl generator includes a plurality of radial swirl vanes and said second swirl generator includes a plurality of circumferential air swirl vanes.

2. An industrial heating burner including a fuel discharge device, an axial fuel supply pipe extending upstream from the fuel discharge device, a flame retention cone surrounding the fuel discharge device and extending downstream from and radially outwardly of the device, a first combustion air swirl generator having an inlet for receiving a supply of combustion air and an outlet, an outer collar surrounding the fuel supply pipe, said outer collar having a downstream end joined to the flame retention cone and an upstream end joined to the swirl generator outlet, and a plurality of secondary air flow holes formed through said flame retention cone within said outer collar, said holes being essentially uniformly spaced on the surface of the cone whereby combustion air swirled by said generator flows inside said outer collar, is thrown radially outwardly against said outer collar and is partially dammed by the cone to provide an essentially uniform swirling flow of combustion air through the openings in the cone and around the interior of the cone;

wherein said first air swirl generator surrounds the fuel supply pipe and the burner includes a second combustion air swirl generator surrounding the flame retention cone and the outer collar and having an inlet for receiving a supply of combustion air and an annular outlet surrounding the downstream end of the cone and the outer collar, said second swirl generator swirling combustion air in a direction opposite to the direction of swirl of said first combustion air swirl generator; and wherein the flame retention cone includes at least two rows of regularly spaced combustion air holes formed therethrough, said holes being spaced around the circumference of the cone with the holes in one row located circumferentially between the holes in the other row.

3. A burner as in claim 2 wherein said first and second air swirl generators each impart equal magnitude angular momentum to their respective combustion air flows, the direction of the angular momentum imparted by the first air swirl generator being opposite to the direction of the angular momentum imparted by the second air swirl generator.

4. A burner as in claim 3 wherein said first air swivel generator imparts a more active swirl to the combustion air passing through than does said second air swirl generator.

5. An industrial heating burner including an axially aligned fuel discharge device, a flame retention member surrounding the fuel discharge device, an axially aligned generally annular tile extending downstream from the flame retention member and defining a combustion chamber, a first combustion air swirl generator having an outlet communicating with the interior of the flame retention member, a second combustion air swirl generator having an annular outlet surrounding the flame retention member and communicating with the wall of the combustion chamber, the inlets of the swirl generators communicating with a source of combustion air, said first swirl generator including means for swirling combustion air in a first circumferential direction, the second swirl generator including means for swirling combustion air in a circumferential direction opposite to the first circumferential direction whereby air, flowing through the said second swirl generator swirls along the interior of the combustion chamber and the air flowing through the first swirl generator burns, expands and shear mixes against the counter-rotating air from the second air swirl generator.

6. A burner as in claim 5 wherein said member comprises the frustoconical flame retention cone opening in a direction toward the combustion chamber, a plurality of combustion air flow openings formed through the flame retention cone, said openings being spaced uniformly around the cone, a collar surrounding the cone, the downstream end of the collar being secured to the downstream end of the cone and the upstream end of the collar being connected to the first combustion air swirl generator outlet, said second combustion air swirl generator including a plurality of swirl vanes on the outer surface of the collar spaced around the circumference thereof.

7. A burner as in claim 6 wherein said first combustion air swirl generator is annular, includes a plurality of radial swirl vane generators and surrounds the burner axis.

8. An industrial burner as in claim 6 wherein the diameter of said openings adjacent the downstream end of the cone is smaller than the diameter of said openings adjacent the upstream end of the cone.

9. An industrial burner as in claim 8 wherein the flame retention cone includes circumferentially spaced rows of air flow openings, said openings in one row being spaced circumferentially between the openings in adjacent rows.

* * * * *